US005612704A

United States Patent [19]

Cole

[11] Patent Number: 5,612,704

[45] Date of Patent: Mar. 18, 1997

[54] RETRACTABLE ANTENNA

[75] Inventor: Richard A. Cole, Salisbury, United Kingdom

[73] Assignee: Nokia Mobile Phones Ltd., Salo, Finland

[21] Appl. No.: 360,969

[22] Filed: Dec. 21, 1994

[30] Foreign Application Priority Data

Dec. 22, 1993 [GB] United Kingdom ..... 9326190

[51] Int. Cl.[6] ..... H01Q 1/24

[52] U.S. Cl. ..... 343/702; 343/895; 343/900

[58] Field of Search ..... 343/900, 702, 343/895, 901, 906; H01Q 1/24

[56] References Cited

U.S. PATENT DOCUMENTS 4,121,218 10/1978 Irwin et al. ..... 343/702
5,446,469 8/1995 Makino ..... 343/702

FOREIGN PATENT DOCUMENTS 0511577 11/1992 European Pat. Off. .
2253949 9/1992 United Kingdom .

OTHER PUBLICATIONS

Patent Abstracts of Japan, vol. 15, No. 213 (E-1073), May 30, 1991.
Motorola Technical Developments, vol. 19, Jun. 1993, p. 118, HEL/TEL Antenna, James T. Wiggenhorn.

*Primary Examiner*—Michael C. Wimer
*Attorney, Agent, or Firm*—Perman & Green

[57] ABSTRACT

A helical antenna (17)is permanently mounted onto the housing (15) of a radio transmitter/receiver, such as a mobile cellular telephone. An elongate antenna (18) is mountable within the housing so as to be movable between a retracted position (FIG. 1) and an extended position (2). The elongate antenna (18) has a conductive portion (18*c*) arranged to short-circuit the helical antenna (17) when said helical antenna is placed in its extended position.

11 Claims, 1 Drawing Sheet

Fig.1.
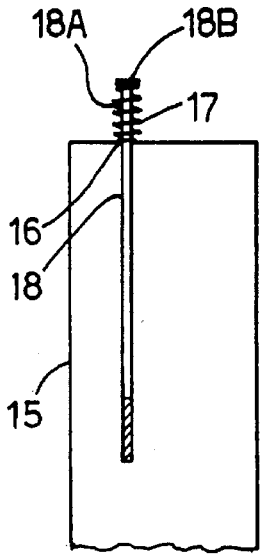
Fig.2.
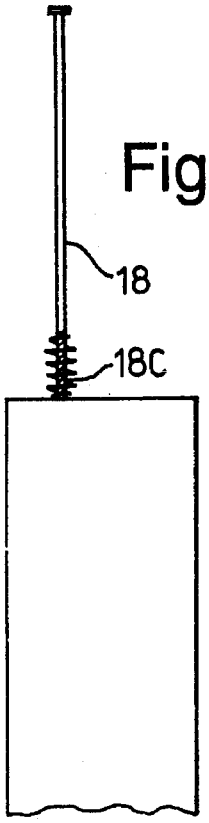
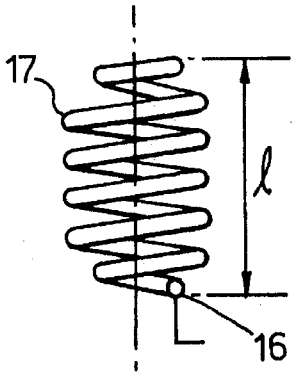
Fig.3.
Fig.4.
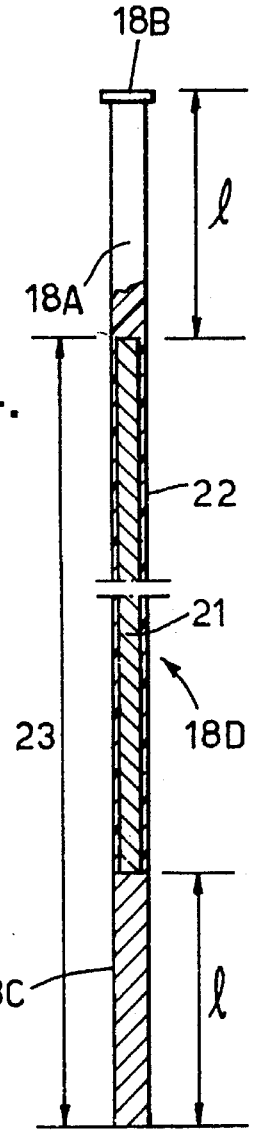

RETRACTABLE ANTENNA

BACKGROUND OF THE INVENTION

This invention relates to an antenna assembly mountable onto a housing for a radio device. The retractable antenna assembly may be applied, for example, to a portable radio and, in particular, to a hand portable radio telephone, such as a cellular telephone.

A radio intended for two-way communication generally operates with either an external rod antenna or with an internal antenna. An external rod antenna may be of the fixed type, having a predetermined length, or of the retractable type. Subject to the operating transmission frequency, fixed length antennas may be relatively short, however, they are not conducive to compact design nor are they particularly suitable for a radio intended to be carried in a pocket or other receptacle offering restrictive space. Alternatively, retractable antennas are convenient for this purpose because they can be folded away when the radio is not in use. When a large retractable antenna is required, a telescopic tube type antenna may be employed.

A known portable radio is disclosed in U.S. Pat. No. 3,087,117 having two antennas. A first antenna is an internal element type antenna and the second is a retractable element type antenna. In addition, the equipment also contains means for automatically switching between the two elements according to the physical position of the retractable element. Hence, the retractable antenna is operable in an extended position while the internal antenna element becomes operable when the retractable element is in its retracted position.

With dual antenna systems, it is important that both antennas should provide efficient operation under their respective operating condition. For example, while an elongate external antenna may provide better sensitivity and range during normal use, the less efficient internal antenna, usually of the helical type, must provide satisfactory performance during stand-by operation.

U.S. Pat. No. 4,868,576 discloses an antenna for a portable cellular telephone comprising a helical coil at the base of a retractable elongate element. The retractable element, which extends through the helical coil, has non-conductive portions at its two ends, whereby, in the extended position, the elongate element is capacitively coupled to the helical coil, while in its retracted position, the elongate element is substantially de-coupled from the helical coil. In order to improve the performance of the helical coil, said coil is permanently mounted onto the housing of the radio transceiver.

A problem with the arrangement shown in U.S. Pat. No. 4,868,576 is that the elongate antenna and the helical antenna must be designed so as to interact correctly, given that, due to the capacitive coupling, the helical antenna is still effectively in-circuit when the elongate antenna is in its extended position.

An alternative arrangement is disclosed in European Patent Publication No. 0 516 490, in which an antenna assembly comprises an elongate ant mounted in a support and movable between a retracted position and an extended position. A helical antenna element is carried at one end of the elongate member, such that, when the elongate member is extended, the helical antenna is effectively taken out of circuit. Thus, this solution overcomes the problem of the helical antenna being in-circuit during operation of the elongate antenna. However, a problem with this arrangement is that the helical antenna must be supported by the elongate antenna when said elongate antenna is extended, thereby increasing the risk of either of said antennas being damaged during operation.

It is an object of the present invention to provide an improved antenna assembly mountable onto a housing for a radio device. In particular, it is an object of the present invention to provide an antenna assembly mountable onto a housing for a radio device which overcomes the problems identified above.

SUMMARY OF THE INVENTION

According to a first aspect of the present invention, there is provided an antenna assembly mountable onto a housing of a radio device, comprising a helical antenna permanently mountable onto said housing, and an elongate antenna mountable within said housing so as to be movable between a retracted position and an extended position, wherein said elongate antenna has a conductive portion arranged to short-circuit the helical antenna when said elongate antenna is placed in its extended position.

Thus, an antenna assembly in accordance with the present invention provides a compact and convenient dual antenna arrangement, which is ideally suited for portable radio applications and which can be manufactured and assembled in a relatively straightforward manner at modest cost. Both of the antenna elements may be external to the radio housing for optimum radiation performance. In the extended position, only the elongate antenna element is active whereas, in the retracted position, the helical antenna is active. However, it should be appreciated that, while the elongate antenna is in its extended position, the helical antenna still remains attached to the radio housing, thereby miniraising the risk of said helical antenna being damaged.

In a preferred embodiment, the radio device is a radio transmitter and said radio device may also be a radio receiver. Preferably, the radio device is a cellular telephone.

In a preferred embodiment, the helical antenna is mounted to a housing by being electrically connected at one end to a circuit board supported within the housing. Preferably, the circuit board supplies radio frequency signals to said connected end. Preferably, the other end of said helical antenna is left open, to facilitate the radiation of electro magnetic signals.

In a preferred embodiment, the elongate antenna extends within the coil of the helical antenna and, preferably, the diameter of the coil of the helical antenna reduces at its ends so as to be in contact with the elongate antenna.

In a preferred embodiment, the retractable antenna includes a non-conductive end portion which enters the coil of the helix when the elongate antenna is retracted into the housing.

The term "elongate antenna" encompasses a rod type antenna or a coil type antenna having a generally elongate configuration. The term "helical" is not restricted to a helix having a uniform diameter and extends to all coil type antennas.

BRIEF DESCRIPTION OF THE DRAWINGS

An embodiment of the invention will now be described, by way of example only, with reference to the accompanying drawings, in which:

FIG. 1 is a schematic cross section of a portable cellular radio telephone having a helical antenna and an elongate antenna, wherein said elongate antenna is in its retracted position;

FIG. 2 is a schematic cross section of a portable cellular radio telephone having an helical antenna and an elongate antenna, wherein said elongate antenna is in its extended position;

FIG. 3 details the helical antenna shown in FIGS. 1 and 2; and

FIG. 4 details the elongate antenna shown in FIGS. 1 and 2.

DETAILED DESCRIPTION OF THE INVENTION

A portable cellular radio telephone is shown in FIG. 1, having a housing 15 enclosing a conventional transmitter and receiver, coupled via a duplexer to an antenna feed assembly it should be appreciated that the housing also encloses all of the other features conventionally found in a portable cellular telephone, although these are not particularly pertinent to the present invention.

In its transmitting mode, a coaxial feed supplies radio frequency signals to an external terminal 16, which may be a simple PCB contact, which is in turn connected to a first end of a helical antenna 17. An elongate antenna 18 is shown in its retracted position, however, a portion 18*a* of said elongate antenna remains within the coil of the helical antenna, restrained by an end-stop 18*b*.

The end portion 18*a* of the elongate antenna 18 does not actually contain conducting material and does not therefore affect the electrical characteristics of the operative helical antenna.

The elongate antenna 18 is shown in its extended position in FIG. 2. The antenna 18 includes a second conducting end portion 18*c* which, when said antenna is fully extended, provides an electrical short circuit between terminal 16 and the top of the helical antenna 17. Thus, when the elongate antenna is placed in its extended position, the helical antenna is effectively short circuited and thereby taken out of circuit. Consequently, the extended elongate antenna operates as the communicating antenna, unaffected by the presence of the short circuited helical antenna.

The helical antenna 17 is detailed n FIG. 3. The helix may be considered as being wound round a notional core and, as shown in FIG. 3, the diameter of said core is smaller towards the ends of the coil than at its center. The diameter of the core at the ends of the coil is such that it provides an interference fit against the elongate antenna, as it slides between its retracted and extended positions. As previously stated, the helical antenna is permanently connected to the housing 15, via the radio frequency supply terminal 16. The helical antenna is also arranged to have a predetermined length L, which is closely monitored to ensure correct co-operation with the ends of the elongate antenna 18.

The elongate antenna 18 is detailed in FIG. 4. The elongate antenna includes a central conductor 21 which may be a solid rod antenna or, alternatively, may be in the form of a close-wound coil, which not only enhances flexibility of the elongate member and so reduces the risk of breakage, but also reduces the physical length of the antenna. The coil may be made of silver plated beryllium-copper wire and, subject to the frequency of the transmitted signals, may have an equivalent electrical length of a quarter wave length or a three eighths wave length.

Over a central portion 18*d*, the central conductor 21 of the elongate antenna 18 is enclosed with an insulating sleeve 22 made of a flexible plastics material.

At the second conducting end portion 18*c*, there is no insulating plastics material and the portion is fabricated from solid conducting material. However, at the opposite end 18*a* the antenna is fabricated from solid insulating material and it should be appreciated that the effective length of the antenna 23 is that made up from the central portion 18*d* and the lower conductive portion 18*c*.

The lower conductive portion 18*c* of the elongate antenna is of substantially similar length to length L of the helical antenna 17. This ensures that when the elongate antenna is fully extended, the top of the helical antenna is in contact with the conductive portion 18*c* of the elongate antenna, thereby effectively providing a short circuit between the top of the helical antenna and the bottom of the helical antenna, where said antenna is connected to the radio frequency supply contact 16.

It will also be appreciated that when the elongate antenna is in its retracted position, the upper portion 18*a*, which is non-conductive, is the only part of said elongate antenna which extends outside the housing 15. Consequently, even if contact 16 is touched by said antenna, no electrical contact is made due to the electrical non-conductive nature of the top portion 18*a*.

In view of the foregoing description, it will be evident to a person skilled in the art that various modifications may be made within the scope of the present invention.

What is claimed is:

1. An antenna assembly mountable onto a housing for a radio device, comprising:

a helical antenna permanently mountable on said housing, and an elongate antenna mountable within said housing so as to be movable between a retracted position and an extended position, wherein said elongate antenna has a conductive portion arranged to short-circuit the helical antenna when said elongate antenna is placed in its extended position and wherein the coil diameter of the helical antenna reduces at its ends so as to contact the elongate antenna.

2. An antenna assembly according to claim 1, wherein the radio device is a radio transmitter.

3. An antenna assembly according to claim 1, wherein said radio device is a receiver.

4. An antenna assembly according to claim 1, wherein said radio device is a cellular telephone.

5. An antenna assembly according to claim 1, wherein the helical antenna is mounted to a housing by being electrically connected at one end to an electrical contact.

6. An antenna assembly according to claim 5, wherein said contact supplies radio frequency signals to said connected end.

7. An antenna assembly according to claim 6, wherein the other end of said helical antenna is open circuit.

8. An antenna assembly according to claim 1, wherein the elongate antenna extends within the core of the helical antenna.

9. An antenna assembly according to claim 1, wherein the elongate antenna includes a non-conductive end portion which enters the core of the helical antenna when the elongate antenna is placed in its retracted position.

10. A radio telephone comprising:

a radio telephone housing;

a helical antenna permanently mounted on the housing and extending from the housing;

an elongate antenna movably mounted to the housing between an extended position and a retracted position relative to the radio telephone housing, the elongate antenna extending through the helical antenna and being movable relative thereto; and wherein the elongate antenna has a conductive portion arranged to short-circuit the helical antenna when the elongate antenna is placed in its extended position, wherein the coil diameter of the helical antenna reduces at least at one of its ends so as to contact the elongate antenna.

11. A radio telephone according to claim 10, wherein the diameter of the helical antenna reduces at both of its ends so as to contact the elongate antenna.

* * * * *